US005134941A

United States Patent [19]

Gortan

[11] Patent Number: 5,134,941

[45] Date of Patent: Aug. 4, 1992

[54] ROTARY DEVICE FOR GUIDING A SUSPENDED GONDOLA ALONG A VERTICAL CABLE

[75] Inventor: Guido Gortan, Itzig, Luxembourg

[73] Assignee: Secalt S.A., Luxembourg, Luxembourg

[21] Appl. No.: 643,418

[22] Filed: Jan. 22, 1991

[30] Foreign Application Priority Data

Jan. 26, 1990 [LU] Luxembourg ..... 87667

[51] Int. Cl.[5] ..... B61B 12/02

[52] U.S. Cl. ..... 104/182; 105/150; 105/151; 191/76

[58] Field of Search ..... 104/87, 93, 112, 113, 104/182; 105/151, 150; 191/76; 187/6, 7, 95; 182/142, 143, 144

[56] References Cited

U.S. PATENT DOCUMENTS 489,234 1/1893 Reutlinger ..... 191/76
665,369 1/1901 Lachenmeyer ..... 191/76
4,434,876 3/1984 McKechnie ..... 187/95
4,458,603 7/1984 Voecks ..... 104/182
4,462,316 7/1984 Tupper ..... 105/151

FOREIGN PATENT DOCUMENTS 817506 9/1937 France ..... 104/173.2

*Primary Examiner*—Robert J. Oberleitner
*Assistant Examiner*—Kevin D. Rutherford
*Attorney, Agent, or Firm*—Thomas S. Baker, Jr.

[57] ABSTRACT

The invention relates to a device for guiding a moving body (1) along a tensioned cable (4) attached at intervals to a building facade (3) and at a given distance therefrom. It comprises a pivoting device (7) formed by a pair of stars (8) parallel, coaxial and integral with one another, the points (9) of which face one another, pivoting about an axis perpendicular to the cable axis (4), the axis of the pair of stars (8) being rotationally integral with the structure of the guided moving body (1).

19 Claims, 4 Drawing Sheets

ROTARY DEVICE FOR GUIDING A SUSPENDED GONDOLA ALONG A VERTICAL CABLE

BACKGROUND OF THE INVENTION

This invention relates to a device for guiding a moving body along a tensioned cable attached at intervals to a building facade and at a given distance therefrom.

Vertical guidance devices for suspended gondolas traveling along a facade are known. The aim of these devices is to prevent the gondola from rocking, particularly under the effect of wind in high-rise installations.

According to one conventional design, these devices are produced by virtue of elements, such as stringers, attached to the gondolas, cooperating with vertical hollow sections incorporated in the structure of the facade, the ends of said elements, which correspond in profile to said sections, sliding into the latter to produce a flush fitting whenever the gondola travels up or down. The guiding assembly generally consists of two stringers per gondola, said stringers being attached at each end of the latter, and the interval between the stringers being the same as the interval between two facade sections.

In some cases the facade structures do not include such sections, which are then replaced by vertical guide cables tensioned between their ends. In these instances the gondolas are guided by these cables by means of tubes or sleeves, into which said cables are threaded, and which are attached to the end of guide stringers which form part of the gondola structures. Generally speaking, there are two guides for each gondola, and they are respectively attached by their ends.

One disadvantage of such an arrangement is that at the site of each attachment tube there is an obstacle for the gondola guiding tube seated on the same cable. This therefore makes it necessary to disconnect the guide tube and reconnect it once the attachment tube has been negotiated following corresponding movement of the gondola.

SUMMARY OF THE INVENTION

It is the object of this invention to present a guidance device ensuring cooperation of the guide stringer and the guide cable by means of a device making it possible to negotiate the attachment tubes or sleeves situated at successive intervals along the corresponding guide cable, while maintaining the guide linkage the whole time.

This object is achieved, in the guidance device according to the invention, by a pivoting device formed by a pair of stars which are parallel, coaxial and integral with one another, and the points of which face one another, which pivots about an axis perpendicular to the cable axis, the axis of the pair of stars being rotationally integral with the structure of the guided moving body.

According to one feature of the invention, a means for attaching the axis of the pair of stars to the moving body is so positioned that the pair of stars constantly tensions the guide cable as the moving body is traveling, taking into account the length of the points of the pair of stars.

According to a further feature of the invention, the pair of stars is provided laterally and integrally with a prismatic element whose axis is coaxial to that of the pair of stars, said prismatic element cooperating with a rotatable member, the moving end of which is pressed by a spring against a lateral face of the prismatic element so as to reset the position of the pair of stars in a stable preferential orientation of its points when said pair of stars has been rotated by virtue of one of its points meeting an element connecting the guide cable to the facade, due to the vertical travel of the moving body.

According to yet another feature of the invention, the pair of stars is so configured, and the prismatic element so configured and disposed, that with each rotational impetus to which the pair of stars is subjected, the latter adopts, or tries to adopt, when remote therefrom, a stable preferential position in which a pair of points is in a plane perpendicular to the cable axis.

According to an additional feature of the invention, the axis bracket of the pair of stars is mounted on a crosspiece perpendicular to said bracket, into which the latter slides laterally under the action of a spring which thus constantly presses the hub of the pair of stars against the guide cable, notably when the direction of the guide cable, at the site of guidance, varies with respect to the direction in which the moving body is traveling along its suspension cable or cables.

According to still further features of the invention, the pair of stars may be disposed either in a plane that is either perpendicular or parallel to the plane of the facade, or else two pairs of stars perpendicular to one another may be provided.

This simultaneously affords the advantages of continuous reliable guidance over the entire height through which the gondola travels, of simplified control, and also of a saving in time.

BRIEF DESCRIPTION OF THE DRAWINGS

The invention will now be described by way of examples with reference to the accompanying drawings, wherein:

In FIGS. 1 and 2 there can be seen a gondola 1 suspended by two cables 2 in front of a facade 3 of a building. The gondola 1 is moved up and down by means of the cables 2. Two guide cables 4 are tensioned along the facade 3 and are used to guide the gondola 1 as it travels vertically up or down.

Figure 2:
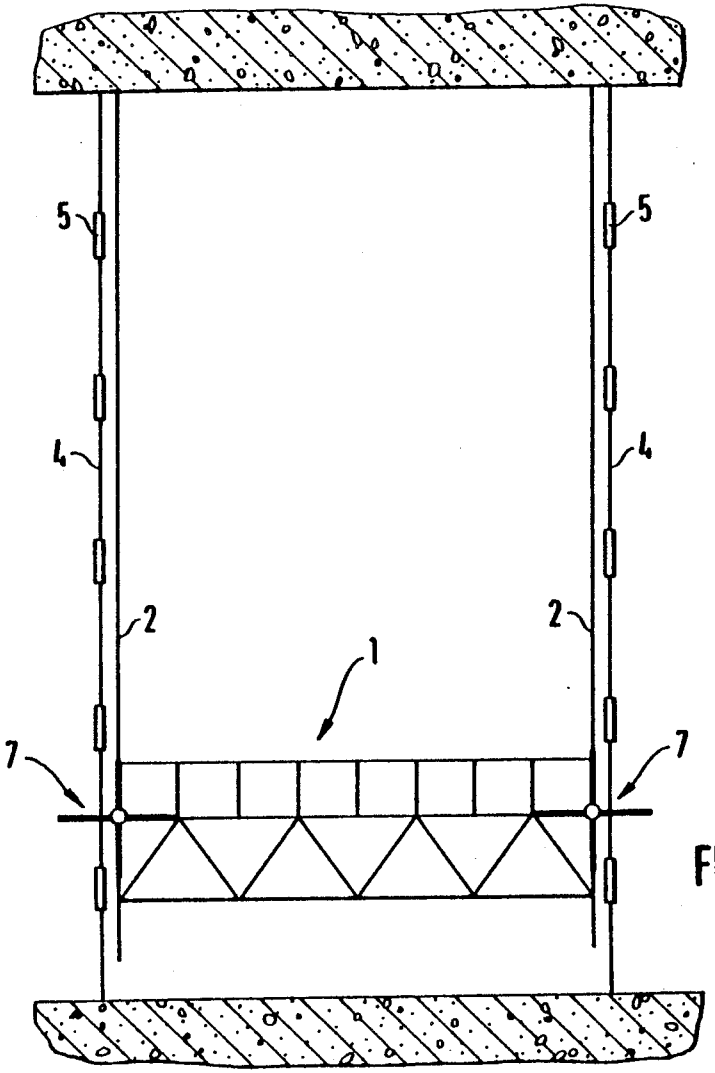
FIG. 2 shows a front view of the guidance device according to to the invention.
Figure 1:
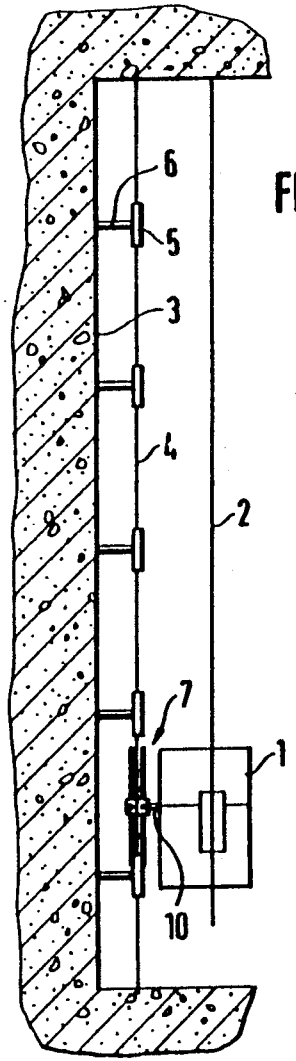
FIG. 1 shows a side view of the guidance device according to the invention.
Figure 3:
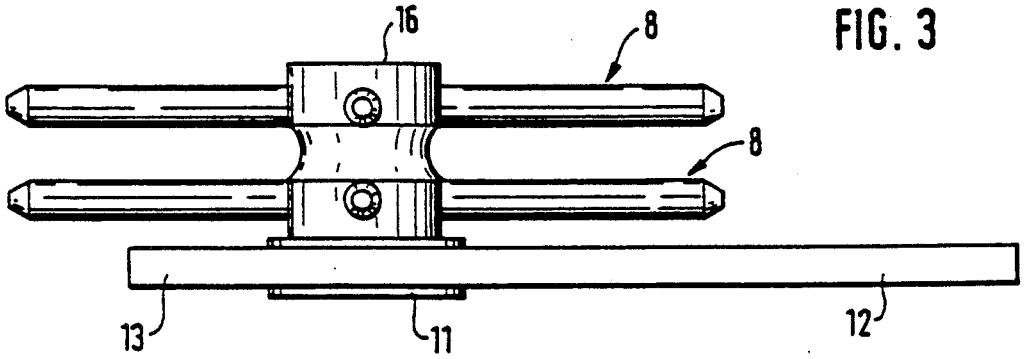
FIG. 3 shows a horizontal projection of a pair of stars of the guidance device according to the invention.
Figure 4:
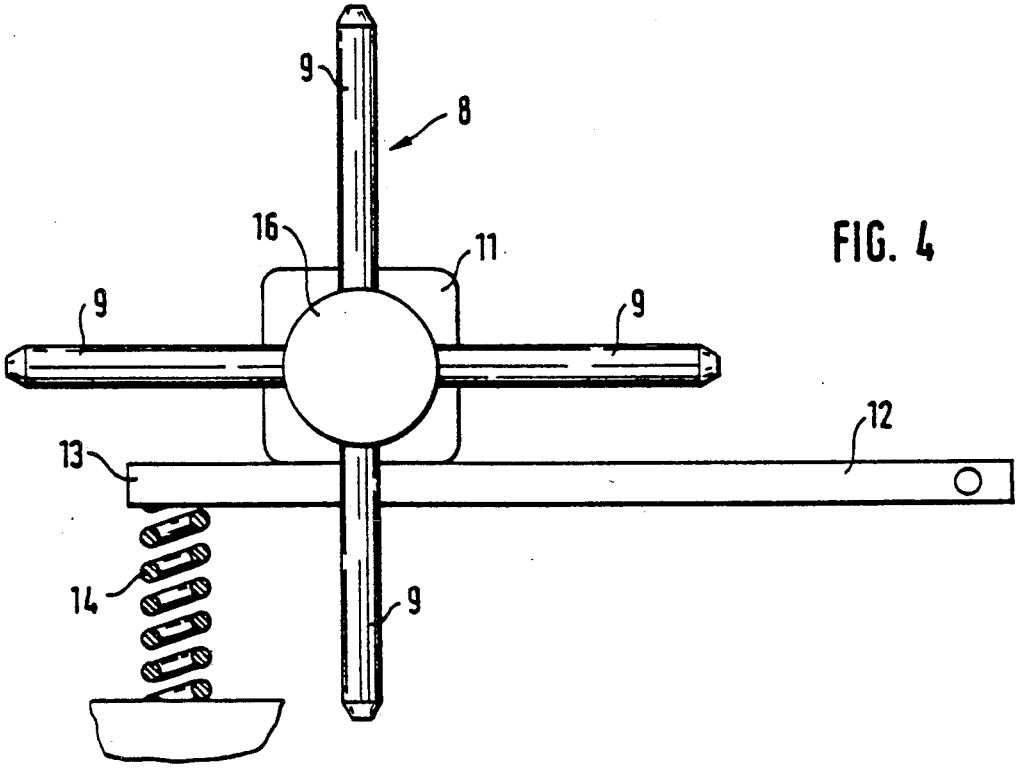
FIGS. 4 and 5 show a front view of a pair of stars of the guidance device in different service positions.
Figure 5:
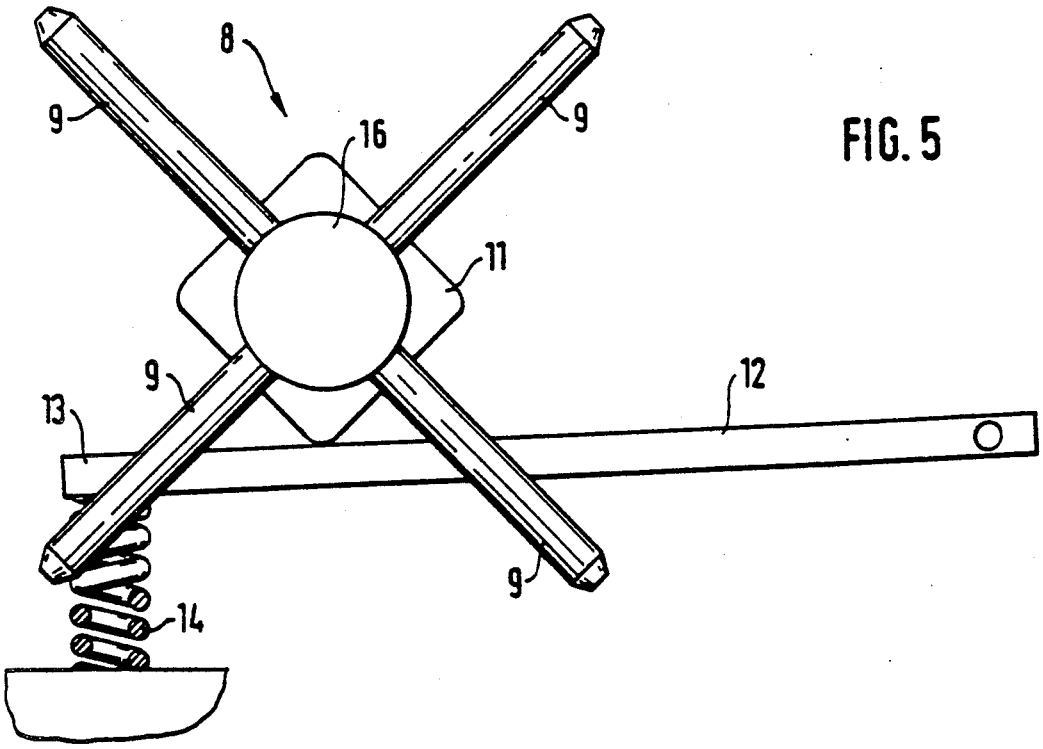
Figure 6:
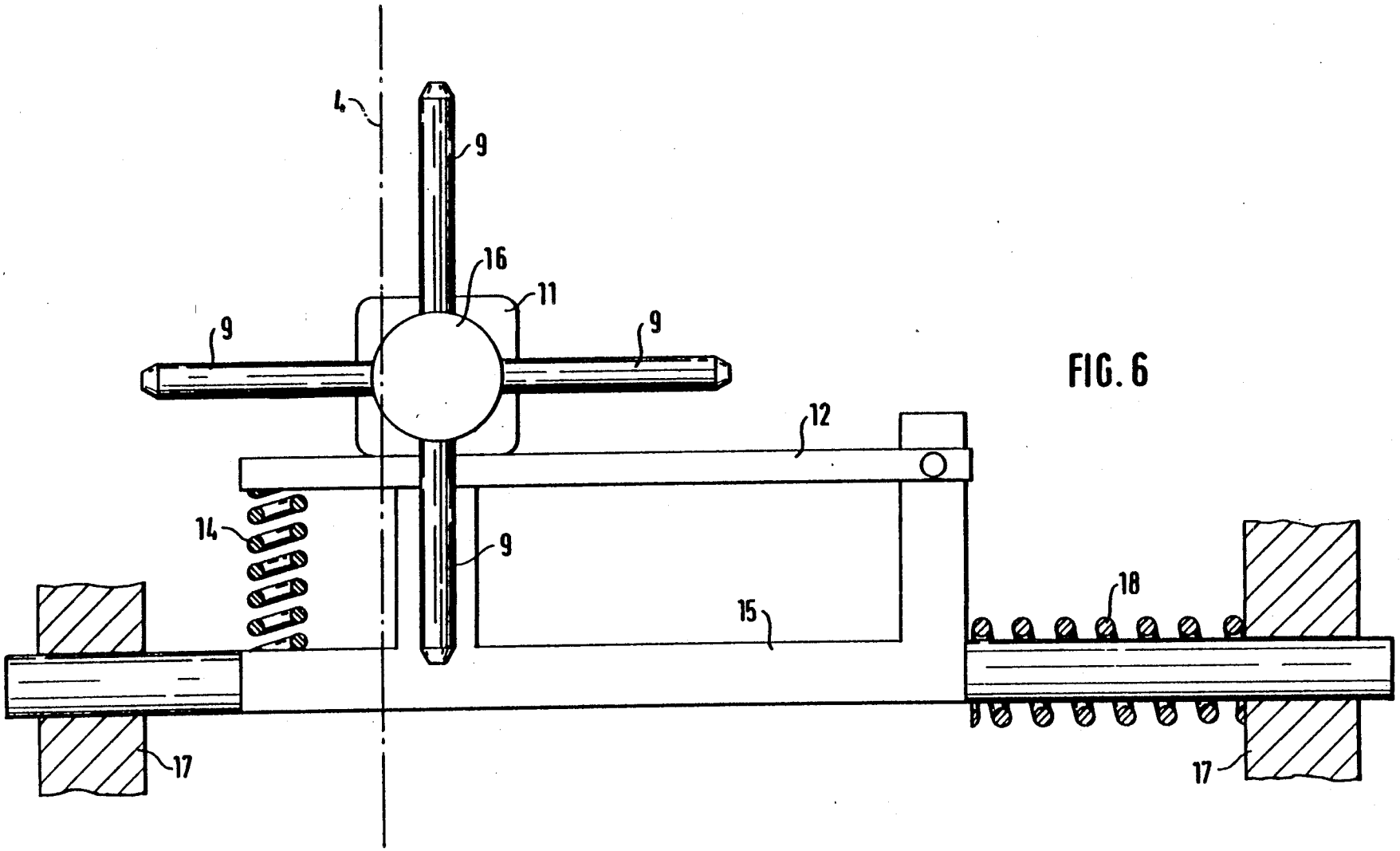
FIG. 6 shows a front view of a pair of stars and its bracket.

The guide cables 4 are attached to the structure of the facade and at a suitable distance therefrom by passing at regular intervals, say every ten meters, into attachment tubes or sleeves 5 themselves situated at the end of arms or yokes 6 attached to the facade 3.

A guide element 7 formed by a pair of parallel stars 8 mounted in integral manner on a common pivoting axis and the respective points 9 of which face each other pairwise, to produce the same number of forks, said guide element 7 being disposed at the end of a stringer 10 such that at any instant, and whatever the rotational position of said guide element, some point of the guide cable 4 is tensioned by the fork formed by two corresponding points 9 of the pair of stars 8.

DESCRIPTION OF PREFERRED EMBODIMENT

According to a preferred embodiment, the pair of stars 8 is disposed in a plane parallel to that of the facade 3, but it could be disposed in another plane, notably in the plane perpendicular to that of the facade 3. It is likewise possible to combine a plurality of guidance devices 7 in different planes in order to lock one cable 4.

The axis of the guidance device 7 is positioned such that the guide cable 4 is surrounded by the two corresponding points 9 of a pair of stars 8. In accordance with this positioning, it will be seen that when the gondola 1, traveling vertically either up or down, brings a star point 9 into contact with an attachment arm 6 of the guide cable 4, it causes the guidance device 7 to rotate, with the result that when the star point 9, in the guidance position, detaches itself from the cable 4, one of the two points 9 adjacent thereto in the direction of rotation relays it into a guidance position.

A pair of stars 8 may have a varying number of points 9, provided that the number and arrangement of these points 9 is compatible with the scheme of travel of this pair of stars 8 with respect to the siting of, and space required by, the attachment points 5, 6 of the guide cable 4. A preferred example would be that of a pair of stars having four points disposed at 90° angles in the same plane.

In order to reset each pair of stars 8 in a stable preferential position each time an attachment point 5, 6 of the guide cable 4 has been negotiated, a prismatic element 11 is attached laterally and coaxially to each pair of stars 8 so as to form a cam cooperating with a rod 12 pivoting at one 13 of its ends which is returned by a spring 14. This prismatic element 11 is preferably of square cross-section, said prismatic element 11 being positioned such that, in the course of its rotation, and under the effect of the return action of spring 14, it assumes a stable rest position corresponding to one of the pairs of points 9 of the double star 8 being positioned perpendicular to the cable axis.

Each pair of stars 8 is mounted with its hub 16 on an axis bracket 15 mounted on a crosspiece 17 perpendicular to said bracket. The axis support 15 is able to slide into the crosspiece 17 under the action of a spring 18, which accordingly constantly presses the hub 16 of the pair of stars 8 against the guide cable 4, notably when the direction of the guide cable 4, at the site of attachment, its attachment to the facade 3 via an attachment tube 5 and arm 6, varies with respect to the direction in which the gondola 1 travels along its suspension cable or cables 2.

The system is chiefly intended to guide a gondola along a building facade, but with the necessary modifications it can also be used for vertical or inclined guidance of any sort of moving body in line with any other type of building structure.

We claim:

1. A pivoting device adapted to be attached to a moving body for guiding a moving body along a substantially vertical, tensioned cable attached at a set distance to the facade of a building by substantially horizontal attachment elements which comprises:

at least one pair of parallel, coaxial, multi-pointed elements rotatably mounted on a hub;

wherein each of said pair of elements faces each other such that the points of each are in alignment; and wherein the axis of rotation of said elements is perpendicular to the axis of said cable such that the points of said elements simultaneously engage said horizontal attachment elements and rotate to maintain said pivoting device in contact with said cable as said body moves along said cable.

2. The pivoting device of claim 1 further comprising:

a rotatable prismatic element having a plurality of generally flat faces attached to said hub which rotatably mounts each of said pair of multi-pointed elements;

a reset member mounted on said device;

spring means for spring biasing said reset member into contact with one of said faces of said prismatic element; and wherein said reset member sequentially engages each of said faces on said prismatic element as said prismatic element rotates.

3. The pivoting device of claim 2 in which the number of said faces of said prismatic element is equal to the number of points on one of said multi-pointed elements.

4. The pivoting device of claim 3 in which one point of each of said multi-pointed elements extends perpendicular to each of said faces of said prismatic element.

5. The pivoting device of claim 4 in which one point of each of said multi-pointed elements extends perpendicularly to said cable when said reset member engages one of said faces of said prismatic element.

6. The pivoting device of claim 2 in which said axis of rotation of said multi-pointed elements is perpendicular to the facade of the building such that said multi-pointed elements are disposed in a plane parallel to the facade.

7. The pivoting device of claim 2 in which said axis of rotation of said multi-pointed elements is parallel to the facade of the building such that said multi-pointed elements are disposed in a plane perpendicular to the facade.

8. The pivoting device of claim 3 in which said axis of rotation of said multi-pointed elements is perpendicular to the facade of the building such that said multi-pointed elements are disposed in a plane parallel to the facade.

9. The pivoting device of claim 3 in which said axis of rotation of said multi-pointed elements is parallel to the facade of the building such that said multi-pointed elements are disposed in a plane perpendicular to the facade.

10. The pivoting device of claim 4 in which said axis of rotation of said multi-pointed elements is perpendicular to the facade of the building such that said multi-pointed elements are disposed in a plane parallel to the facade.

11. The pivoting device of claim 4 in which said axis of rotation of said multi-pointed elements is parallel to the facade of the building such that said multi-pointed elements are disposed in a plane perpendicular to the facade.

12. The pivoting device of claim 5 in which said axis of rotation of said multi-pointed elements is perpendicular to the facade of the building such that said multi-pointed elements are disposed in a plane parallel to the facade.

13. The pivoting device of claim 5 in which said axis of rotation of said multi-pointed elements is parallel to the facade of the building such that said multi-pointed elements are disposed in a plane perpendicular to the facade.

14. The pivoting device of claim 1 in which said axis of rotation of said multi-pointed elements is perpendicular to the facade of the building such that said multi-pointed elements are disposed in a plane parallel to the facade.

15. The pivoting device of claim 1 in which said axis of rotation of said multi-pointed elements i parallel to the facade of the building such that said multi-pointed elements are disposed in a plane perpendicular to the facade.

16. The pivoting device of claim 1 further comprising:

a bracket on said moving body which slidably mounts said hub mounting said pair of multi-pointed elements such that said hub is movable toward and away from said cable;

wherein said bracket is supported at one end by a cross piece which extends perpendicular to said bracket; and second spring means for spring biasing said bracket and said hub toward engagement with said cable.

17. A pivoting device adapted to be attached to a moving body for guiding a moving body along a substantially vertical, tensioned cable attached at a set distance to the facade of a building by substantially horizontal attachment elements which comprises:

at least one pair of parallel, coaxial, multi-pointed elements rotatably mounted on a hub;

wherein each of said pair of elements faces each other such that the points of each are in alignment;

wherein the axis of rotation of said elements is perpendicular to the axis of said cable such that the points of said elements simultaneously engage said horizontal attachment elements and rotate to maintain said pivoting device in contact with said cable as said body moves along said cable;

a rotatable prismatic element having a plurality of generally flat faces attached to said hub which rotatably mounts each of said pair of multi-pointed elements;

a reset member mounted on said device;

spring means for spring biasing said reset member into contact with one of said faces of said prismatic element;

wherein said reset member sequentially engages each of said faces on said prismatic element as said prismatic element rotates to bias said pair of multi-pointed elements into a position in which at least one point of each element extends in a plane perpendicular to the axis of said cable;

a bracket on said moving body which slidably mounts said hub mounting said pair of multi-pointed elements such that said hub is movable toward and away from said cable;

wherein said bracket is supported at one end by a cross piece which extends perpendicular to said bracket; and second spring means for spring biasing said bracket and said hub toward engagement with said cable.

18. The device of claim 17 in which said pair of stars is disposed in a plane parallel to that of the facade.

19. The device of claim 17 in which said pair of stars is disposed in a plane perpendicular to that of the facade.

* * * * *